US011393412B2

(12) United States Patent
Chen et al.

(10) Patent No.: US 11,393,412 B2
(45) Date of Patent: Jul. 19, 2022

(54) ELECTRONIC DEVICE AND TEMPERATURE ADJUSTMENT METHOD THEREOF

(71) Applicant: ASUSTeK COMPUTER INC., Taipei (TW)

(72) Inventors: Yi-Ching Chen, Taipei (TW); Chia-Feng Yang, Taipei (TW); Chia-Lei Yu, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 17/301,950

(22) Filed: Apr. 20, 2021

(65) Prior Publication Data

US 2021/0343250 A1 Nov. 4, 2021

Related U.S. Application Data

(60) Provisional application No. 63/017,038, filed on Apr. 29, 2020.

(30) Foreign Application Priority Data

Mar. 25, 2021 (CN) ..... 202110330511.X

(51) Int. Cl.
*G09G 3/34* (2006.01)
*G09G 3/36* (2006.01)

(52) U.S. Cl.
CPC ..... *G09G 3/3406* (2013.01); *G09G 2320/041* (2013.01); *G09G 2320/064* (2013.01)

(58) Field of Classification Search
CPC .. G09G 3/36; G09G 1/16; G09G 5/10; G09G 3/20; G09G 3/22; G09G 3/32; G09G 3/34;
(Continued)

(56) References Cited

U.S. PATENT DOCUMENTS

2013/0162701 A1* 6/2013 Yang ..... G09G 3/3406 345/691
2013/0249970 A1* 9/2013 Asano ..... G09G 3/22 345/691
(Continued)

FOREIGN PATENT DOCUMENTS

CN 106707590 A 5/2017
CN 108766366 A 11/2018
(Continued)

*Primary Examiner* — Chanh D Nguyen
*Assistant Examiner* — Nguyen H Truong
(74) *Attorney, Agent, or Firm* — McClure, Qualey & Rodack, LLP

(57) ABSTRACT

An electronic device is provided, including a display panel and a processor. The display panel is configured to display image data and includes a backlight module, and the processor is electrically connected to the display panel. The processor averages current values of the backlight module corresponding to the image data in a first time period, to generate an average current value, and compares the average current value with a current threshold. When the average current value is greater than the current threshold, the processor generates an adjusted maximum current value, and correspondingly reduces current values of the backlight module in a second time period according to the adjusted maximum current value, to reduce a temperature of the electronic device. A temperature adjustment method of an electronic device is also provided.

18 Claims, 4 Drawing Sheets

(58) Field of Classification Search
CPC .. G09G 3/3225; G09G 3/3233; G09G 3/3291; G09G 3/3406; G09G 2320/041; G09G 2320/064; H04N 5/66; H04N 5/369; G02F 1/1335; H05B 33/02; H05B 33/08; H05B 37/02
See application file for complete search history.

(56) References Cited

U.S. PATENT DOCUMENTS

| | | | | |
|---|---|---|---|---|
| 2019/0250692 | A1* | 8/2019 | Kang | G06F 1/3218 |
| 2021/0366375 | A1* | 11/2021 | Chun | G09G 5/391 |

FOREIGN PATENT DOCUMENTS

| | | | |
|---|---|---|---|
| CN | 109256095 | * | 4/2020 |
| CN | 109256095 B | | 4/2020 |

* cited by examiner

ELECTRONIC DEVICE AND TEMPERATURE ADJUSTMENT METHOD THEREOF

CROSS-REFERENCE TO RELATED APPLICATION

This application claims the priority benefit of China Application Serial No. 202110330511.X, filed on Mar. 25, 2021, and U.S. provisional application Ser. No. 63/017,038, filed on Apr. 29, 2020. The entirety of the above-mentioned patent application is hereby incorporated by reference herein and made a part of specification.

BACKGROUND OF THE INVENTION

Field of the Invention

The disclosure relates to an electronic device and a temperature adjustment method thereof.

Description of the Related Art

Heat generated in a display device is dissipated by using a fan and related dissipation mechanism. The temperature of the display device is detected by a sensor. If the temperature of the display device increases, the rotation speed of the fan is increased to dissipate heat. However, noise occurs when the rotation speed increases, and the heat dissipation efficiency is restricted by the upper limit of the rotation speed of the fan. Therefore, it is difficult to maintain the temperature of the display device below an upper limit temperature. As a result, the display device cannot maintain in an optimal operation temperature range with high brightness for a long time. If the temperature continues to increase and exceeds the upper limit of the operation temperature of the display device for a long time, the display device is damaged, and fails to maintain at a stable quality.

BRIEF SUMMARY OF THE INVENTION

According to the first aspect of the disclosure, an electronic device is provided. The electronic device includes a display panel and a processor. The display panel is configured to display image data and includes a backlight module, and the processor is electrically connected to the display panel. The processor averages current values of the backlight module corresponding to the image data in a first time period, to generate an average current value, and compares the average current value with a current threshold. When the average current value is greater than the current threshold, the processor generates an adjusted maximum current value, and correspondingly reduces current values of the backlight module in a second time period according to the adjusted maximum current value, to reduce a temperature of the electronic device.

According to the second aspect of the disclosure, T a temperature adjustment method of an electronic device is provided. The electronic device includes a display panel. The temperature adjustment method includes: averaging current values of a backlight module of the display panel corresponding to image data in a first time period to generate an average current value; comparing the average current value with a current threshold; generating an adjusted maximum current value when the average current value is greater than the current threshold; and reducing current values of the backlight module in a second time period according to the adjusted maximum current value, to reduce a temperature of the electronic device.

In conclusion, in the disclosure, it is determined that whether the temperature of an electronic device is excessively high according to current values of a backlight module corresponding to displayed data in a time period, and there is no need to provide an additional temperature sensor. Therefore, the temperature of the electronic device is dynamically reducing by reducing the current values of the backlight module without increasing costs, allowing the operation temperature of the display device to be maintained in a preset operation temperature range.

DETAILED DESCRIPTION OF THE EMBODIMENTS

Figure 1:
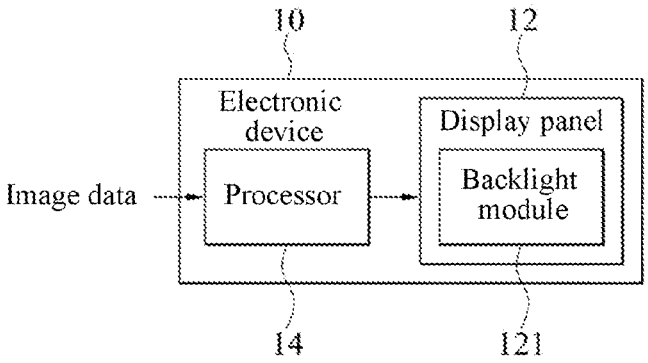
FIG. 1 is a schematic block diagram of an electronic device according to an embodiment of the disclosure.

Referring to FIG. 1, an electronic device 10 includes at least a display panel 12 and a processor 14. The processor 14 is electrically connected to the display panel 12. The display panel 12 further includes a backlight module 121. The processor 14 transmits image data to the display panel, so that the display panel 12 displays the image data. An upper limit current value of the backlight module 121 is a maximum current value. The processor 14 calculates a current value of the backlight module 121 corresponding to the image data according to the image data and the maximum current value. In an embodiment, the processor 14 is an image processor.

In an embodiment, the electronic device 10 is a light-emitting diode (LED) display, a notebook computer, a tablet computer, or a mobile phone.

Figure 2:
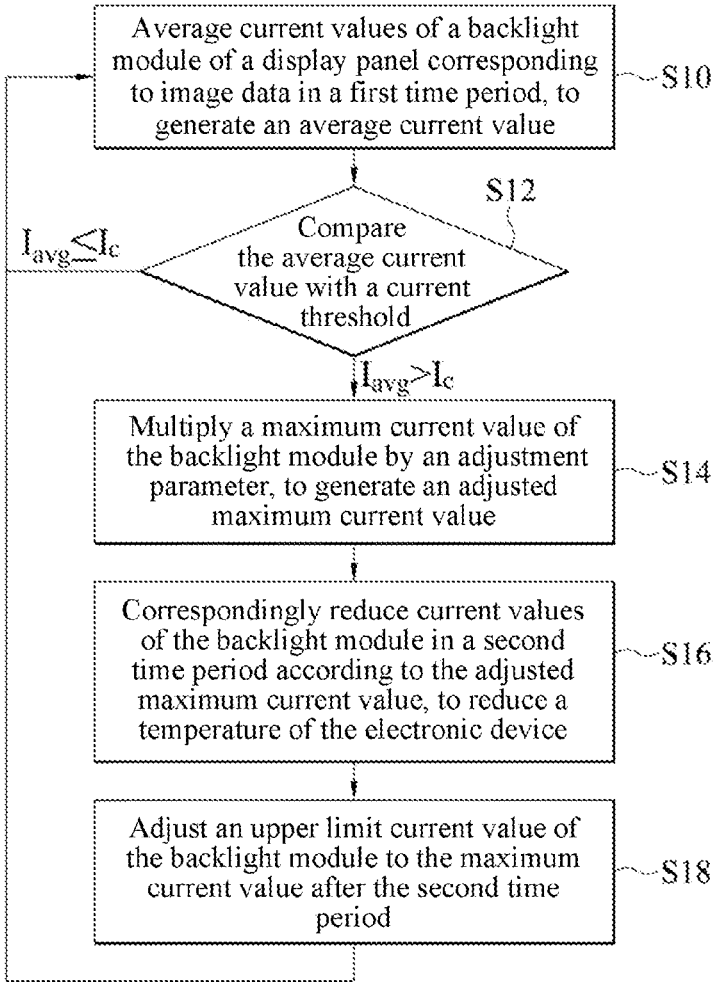
FIG. 2 is a schematic flowchart of a temperature adjustment method according to an embodiment of the disclosure.

Referring to FIG. 1 and FIG. 2, in the electronic device 10, the processor 14 executes a temperature adjustment method, to enable the display panel 12 to maintain at a stable temperature when displaying the image data. The temperature adjustment method includes the steps described hereinafter. In step S10, the processor 14 averages current values of the backlight module 121 corresponding to the image data in a first time period $T_1$, to generate an average current value $I_{avg}$. In an embodiment, the first time period $T_1$ is less than or equal to a time period that required for the electronic device 10 to operate at a maximum current value $I_{max}$ to reach an equilibrium temperature. In an embodiment, the processor 14 calculates a current value of the backlight module 121 according to displayed image content of the image data, and acquires all the current values in the first time period $T_1$ to calculate the average current value $I_{avg}$.

Next, in step S12, the processor 14 compares the average current value $I_{avg}$ with a current threshold $I_c$ to determine whether the average current value $I_{avg}$ is greater than the current threshold $I_c$. When the processor 14 determines that the average current value $I_{avg}$ is less than or equal to the current threshold $I_c$ ($I_{avg} \leq I_c$), step S10 is performed again to calculate an average current value $I_{avg}$ in a next first time period $T_1$. When the processor 14 determines that the average current value $I_{avg}$ is greater than the current threshold $I_c$ ($I_{avg} > I_c$), step S14 is performed.

In step S14, the processor 14 generates an adjusted maximum current value $I_a$ when the average current value $I_{avg}$ is greater than the current threshold $I_c$. Specifically, the processor 14 multiplies the maximum current value $I_{max}$ of the backlight module 121 by an adjustment parameter r, which is expressed as $I_{max}$*r, to generate the adjusted maximum current value $I_a$ ($I_a = I_{max}$*r), where the adjustment parameter r is less than 1. In an embodiment, the processor 14 further selects different adjustment parameters r according to different average current values $I_{avg}$. The larger the average current value $I_{avg}$ is, the smaller the adjustment parameter r is; the smaller the average current value $I_{avg}$ is, the larger the adjustment parameter r is.

As shown in step S16, the processor 14 reduces current values of the backlight module 121 in a second time period $T_2$ according to the adjusted maximum current value $I_a$ (in an embodiment, the processor reduces current values that exceeding the adjusted maximum current value $I_a$ in the current values of the backlight module 121 in the second time period $T_2$ to the adjusted maximum current value $I_a$; or multiplies all the current values of the backlight module 121 in the second time period $T_2$ by the adjustment parameter r, to reduce all the current values), to reduce a temperature of the electronic device 10. In an embodiment, the second time period $T_2$ is less than or equal to a heat dissipation time. The heat dissipation time is a time period required for the electronic device 10 to operate at the current threshold $I_c$ and drop to an equilibrium temperature after reaching an upper limit temperature.

As shown in step S18, the processor 14 adjusts an upper limit current value of the backlight module 121 from the adjusted maximum current value $I_a$ to the maximum current value $I_{max}$ after the second time period $T_2$. Then, the process goes back to step S10 to start a new calculation cycle and repeat the foregoing steps, thus to dynamically adjust the temperature of the electronic device 10 by dynamically adjusting the current value of the backlight module 121.

Figure 3:
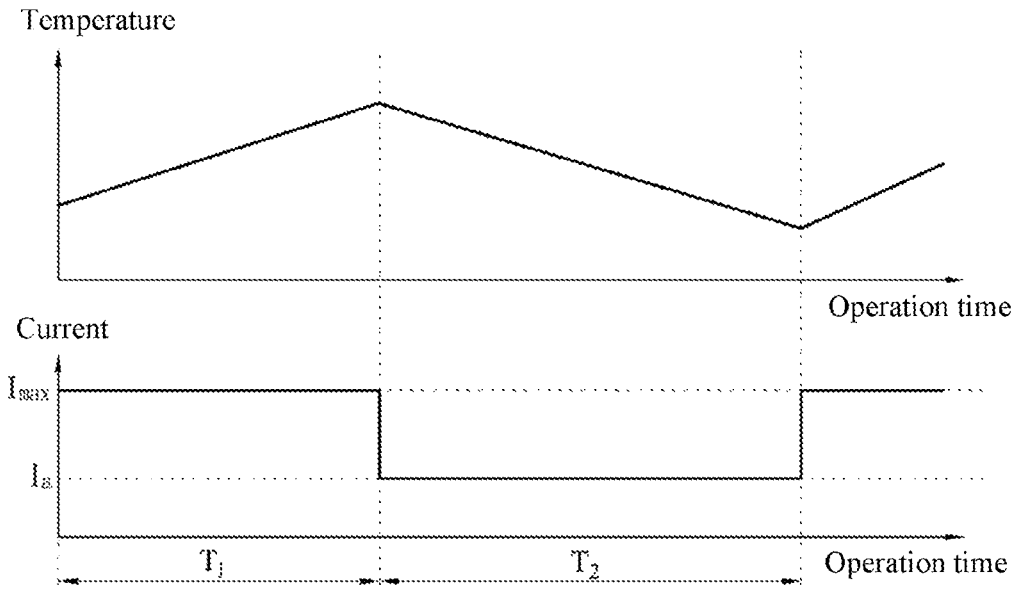
FIG. 3 is a schematic diagram showing a current change of a backlight module according to an embodiment of the disclosure.

Referring to FIG. 1, FIG. 2, and FIG. 3, in the first time period $T_1$ in step S10, when the backlight module 121 operates at the maximum current value $I_{max}$ for a long time, the temperature of the electronic device 10 continues to increase. In step S16, after the processor 14 reduces the upper limit current value of the backlight module 121 to the adjusted maximum current value $I_a$, none of the current values of the backlight module 121 in the second time period $T_2$ is greater than the adjusted maximum current value $I_a$, so the temperature of the electronic device 10 gradually decreases. Therefore, heat is dissipated from the electronic device 10, and the temperature of the electronic device 10 (the display panel 12) is maintained within a stable range. The upper limit current value of the backlight module 121 is adjusted to the original maximum current value $I_{max}$ after the second time period $T_2$.

In an embodiment, the processor 14 further sets different second time periods $T_2$ according to the average current value $I_{avg}$.

Figure 4:
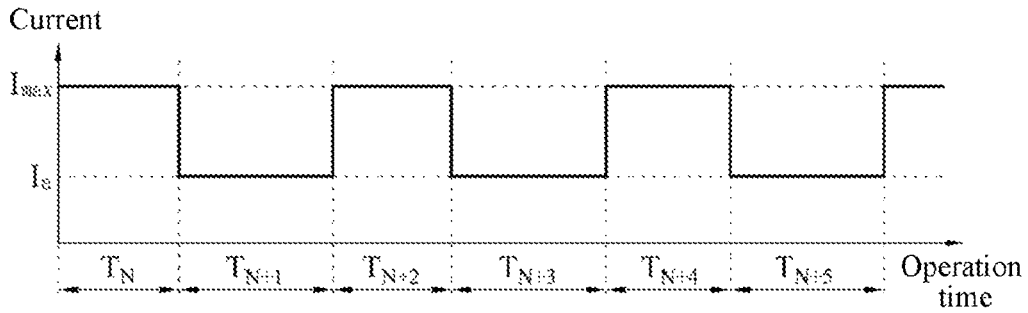
FIG. 4 is a schematic diagram showing a current change of a backlight module according to another embodiment of the disclosure.

Referring to FIG. 1 and FIG. 2, in step S12 of comparing the average current value $I_{avg}$ with the current threshold $I_c$, in an embodiment, there are a plurality of current thresholds $I_c$. Each current threshold $I_c$ corresponds to one adjustment parameter r, and the current threshold $I_c$ is selected according to the average current value $I_{avg}$. In an embodiment, the processor 14 selects a current threshold $I_c$ that is the most closest to the average current value $I_{avg}$ from the current thresholds $I_c$ that are less than the average current value $I_{avg}$, and accordingly performs the next step S14, to differently generate the adjusted maximum current values $I_a$. Referring to FIG. 4, in an $N^{th}$ time period $T_N$, an upper limit current value of the backlight module 121 is a maximum current value $I_{max}$. In an $(N+1)^{th}$ time period $T_{N+1}$, since the processor 14 reduces the upper limit current value of the backlight module 121 from the maximum current value $I_{max}$ to an adjusted maximum current value $I_a$, none of the current values of the backlight module 121 in the $(N+2)^{th}$ time period $T_{N+1}$ is greater than the adjusted maximum current value $I_a$. In an $(N+2)^{th}$ time period $T_{N+2}$, the processor 14 sets the upper limit current value of the backlight module 121 back to the maximum current value $I_{max}$. In an $(N+3)^{th}$ time period $T_{N+3}$, the processor 14 reduces the upper limit current value of the backlight module 121 to an adjusted maximum current value $I_a$. In an $(N+4)^{th}$ time period $T_{N+4}$, the processor 14 sets the upper limit current value of the backlight module 121 back to the maximum current value $I_{max}$ again. In an $(N+5)^{th}$ time period $T_{N+5}$, the processor 14 reduces the upper limit current value of the backlight module 121 to an adjusted maximum current value $I_a$. The rest is deduced by analogy. In this embodiment, in the $(N+1)^{th}$ time period $T_{N+1}$, the $(N+3)^{th}$ time period $T_{N+3}$, and the $(N+5)^{th}$ time period $T_{N+5}$, the adjusted maximum current values $I_a$ are exactly the same, which indicates that average current values $I_{avg}$ previously calculated in the first time period $T_1$ are the same. In some other embodiments, if the calculated average current values $I_{avg}$ are different, the adjusted maximum current values $I_a$ in the $(N+1)^{th}$ time period $T_{N+1}$, the $(N+3)^{th}$ time period $T_{N+3}$, and the $(N+5)^{th}$ time period $T_{N+5}$ correspond to different values.

In an embodiment, referring to FIG. 1 and FIG. 2, in step S16 of reducing the current values of the backlight module 121 in the second time period $T_2$ according to the adjusted maximum current value $I_a$, there are three manners for reducing the current values of the backlight module 121. The first adjustment manner is that the processor 14 reduces the current values of the backlight module 121 by adjusting an upper limit current value of the backlight module 121. In an embodiment, the maximum current value $I_{max}$ is 300 A, the upper limit current value of the backlight module 121 in the second time period $T_2$ is directly adjusted to half the maximum current value $I_{max}$ (150 A). The second adjustment manner is that the processors 14 gradually changes the current values. In an embodiment, the upper limit current value of the backlight module 121 is gradually adjusted to half the maximum current value $I_{max}$ (150 A) in an adjustment time interval.

The third adjustment manner is that the processor 14 adjusts the current values of the backlight module 121 by changing a pulse width modulation (PWM) setting. In an embodiment, an original setting that a current value of 300 A is outputted at a specific quantity of time points in the second time period $T_2$ is adjusted to a setting that a current value of 300 A is outputted only at half the specific quantity of time points in the second time period $T_2$.

Figure 5:
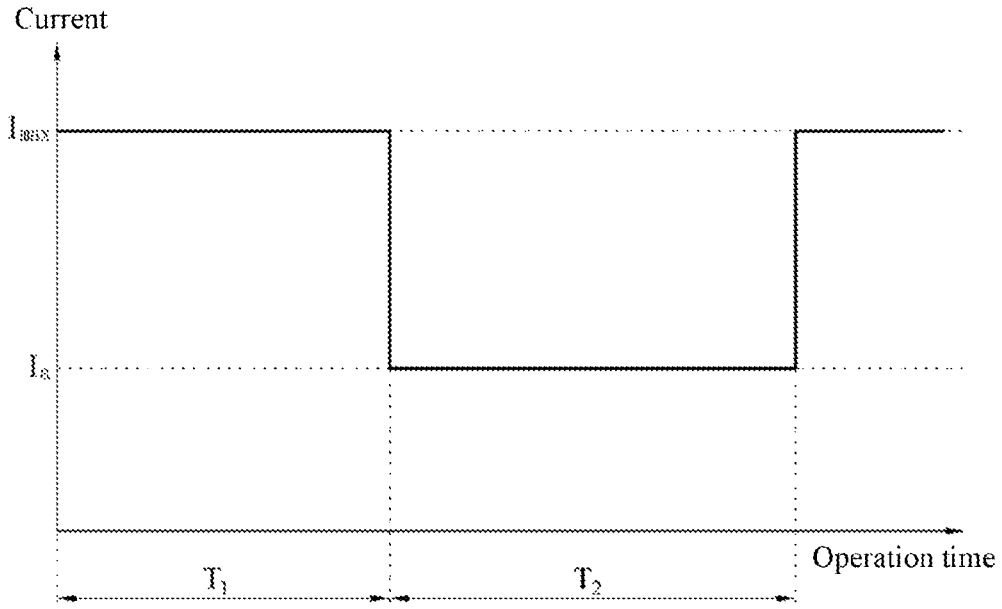
FIG. 5 is a schematic diagram of adjusting a current value of a backlight module according to an embodiment of the disclosure.
Figure 6:
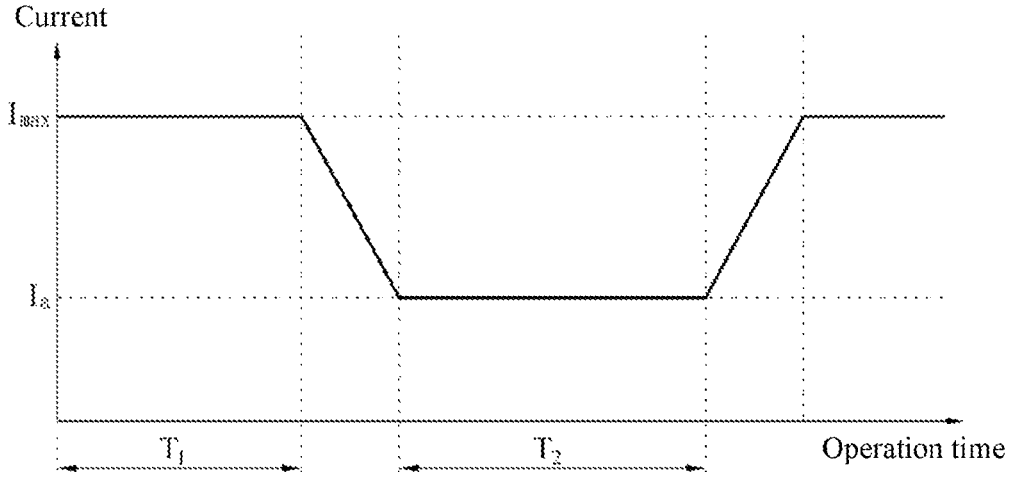
FIG. 6 is a schematic diagram of adjusting a current value of a backlight module according to another embodiment of the disclosure.

Based on the above, whatever the adjustment is implemented by directly changing the upper limit current value or by setting the PWM, the current value of the backlight module 121 is allowed to be adjusted either instantaneously or gradually. Referring to FIG. 1 and FIG. 5, the processor 14 instantaneously reduces the upper limit current value of the backlight module 121 from the maximum current value $I_{max}$ to the adjusted maximum current value $I_a$ or instantaneously increases the upper limit current value from the adjusted maximum current value $I_a$ to the maximum current value $I_{max}$. Referring to FIG. 1 and FIG. 6, the processor 14 gradually reduces the upper limit current value of the backlight module 121 from a maximum current value $I_{max}$ to the adjusted maximum current value lain a time interval, or gradually increases the upper limit current value from the adjusted maximum current value $I_a$ to the maximum current value $I_{max}$ in a time interval. The gradual adjustment mode decreases the discomfort feelings that caused by an abrupt change of picture brightness.

In an embodiment, a rising trend of the temperature of the electronic device is observed for different current settings, so as to learn temperature changes corresponding to the current settings, and a current operation temperature is measured or calculated, to figure out a current-time-temperature correlation, so that subsequently the temperature controlling is achieved by changing the current at intervals of a period of time. Such a current change behavior is periodic, and therefore, the temperature is controlled by periodically adjusting the current value of the backlight module. The rising trends of the temperature of the electronic device and equilibrium temperatures corresponding to different current values of the backlight module are recorded, and a time period required for the electronic device to reach an equilibrium temperature ranges from 0.5 hour to 2 hours. Therefore, the following information is learned in advance: the time period that required for the electronic device operating at the maximum current value to reach an equilibrium temperature; the equilibrium temperatures reached at different currents, where it is learned that an equilibrium temperature reached at the current threshold is less than an upper limit temperature of the electronic device (display panel) by a predetermined temperature difference (which is 5° C. in an embodiment), and the current threshold is regarded as the most stable current value; and a time period required for the electronic device operating at the current threshold that drops to the equilibrium temperature after reaching the upper limit temperature (heat dissipation time period). Therefore, in the disclosure, two or more time periods, such as the first time period and the second time period, are set according to the foregoing information.

In conclusion, in the disclosure, it is determined that whether the temperature of an electronic device is excessively high according to current values of a backlight module corresponding to the displayed data in a time period, and there is no need to provide an additional temperature sensor. Therefore, the temperature of the electronic device is dynamically reducing by reducing the current values of the backlight module without increasing costs, allowing the operation temperature of the display device to be maintained in a set operation temperature range.

In addition, the brightness of the display panel is brighter or darker as the current value of the backlight module is adjusted higher or lower, therefore, users are able to determine whether the electronic device is in a cooling mode by observing a change in the brightness of the display panel.

The embodiments described above are only used for explaining the technical ideas and characteristics of the disclosure to enable a person skilled in the art to understand and implement the content of the disclosure, and are not intended to limit the patent scope of the disclosure. That is, any equivalent change or modification made according to the spirit disclosed in the disclosure shall still fall within the patent scope of the disclosure.

What is claimed is:

1. An electronic device, comprising:

a display panel, comprising a backlight module and configuring to display image data; and a processor, electrically connected to the display panel, the processor averages a plurality of current values of the backlight module corresponding to the image data in a first time period, to generate an average current value, and compares the average current value with a current threshold, wherein when the average current value is greater than the current threshold, the processor generates an adjusted maximum current value, and correspondingly reduces current values of the backlight module in a second time period according to the adjusted maximum current value, to reduce a temperature of the electronic device;

wherein the processor multiplies a maximum current value of the backlight module by an adjustment parameter, to generate the adjusted maximum current value, wherein the adjustment parameter is less than 1, and the first time period is less than or equal to a time period that required for the electronic device operating at the maximum current value to reach an equilibrium temperature.

2. The electronic device according to claim 1, wherein the processor selects the adjustment parameter according to the average current value, and the larger the average current value is, the smaller the adjustment parameter is.

3. The electronic device according to claim 1, wherein the second time period is less than or equal to a heat dissipation time period, and the heat dissipation time period is a time period that required for the electronic device operating at the current threshold to drop to an equilibrium temperature after reaching an upper limit temperature.

4. The electronic device according to claim 1, wherein the processor further sets the second time period according to the average current value.

5. The electronic device according to claim 1, wherein the number of the current threshold is plurality, each of the current thresholds corresponds to one adjustment parameter, and the corresponding current threshold is selected according to the average current value.

6. The electronic device according to claim 1, wherein the processor reduces the current values of the backlight module by directly adjusting an upper limit current value of the backlight module.

7. The electronic device according to claim 1, wherein the processor reduces the current values of the backlight module by changing a pulse width modulation setting.

8. The electronic device according to claim 1, wherein the processor gradually reduces an upper limit current value of the backlight module to the adjusted maximum current value in a time interval, to reduce the current values of the backlight module.

9. The electronic device according to claim 1, wherein the processor adjusts an upper limit current value of the backlight module to the maximum current value after the second time period.

10. A temperature adjustment method of an electronic device, wherein the electronic device comprises a display panel, the temperature adjustment method comprising:

averaging a plurality of current values of a backlight module of the display panel corresponding to image data in a first time period to generate an average current value;

comparing the average current value with a current threshold;

multiplying a maximum current value of the backlight module by an adjustment parameter to generate an adjusted maximum current value when the average current value is greater than the current threshold, wherein the adjustment parameter is less than 1; and reducing current values of the backlight module in a second time period according to the adjusted maximum current value to reduce a temperature of the electronic device;

wherein the first time period is less than or equal to a time period that required for the electronic device operating at the maximum current value to reach an equilibrium temperature.

11. The temperature adjustment method according to claim 10, wherein the adjustment parameter is selected according to the average current value, and the larger the average current value is, the smaller the adjustment parameter is.

12. The temperature adjustment method according to claim 10, wherein the second time period is less than or equal to a heat dissipation time period, and the heat dissipation time period is a time period that required for the electronic device operating at the current threshold to drop to an equilibrium temperature after reaching an upper limit temperature.

13. The temperature adjustment method according to claim 10, wherein the second time period is further set according to the average current value.

14. The temperature adjustment method according to claim 10, wherein in the step of comparing the average current value with the current threshold, the number of the current threshold is plurality, each of the current thresholds corresponds to one adjustment parameter, and the corresponding current threshold is selected according to the average current value.

15. The temperature adjustment method according to claim 10, wherein in the step of reducing the current values of the backlight module in the second time period according to the adjusted maximum current value, the current values of the backlight module are reduced by directly adjusting an upper limit current value of the backlight module.

16. The temperature adjustment method according to claim 10, wherein in the step of reducing the current values of the backlight module in the second time period according to the adjusted maximum current value to reduce a temperature of the electronic device, the current values of the backlight module are reduced by changing a pulse width modulation setting.

17. The temperature adjustment method according to claim 10, wherein in the step of reducing the current values of the backlight module in the second time period according to the adjusted maximum current value to reduce a temperature of the electronic device, an upper limit current value of the backlight module is gradually reduced to the adjusted maximum current value in a time interval, to reduce the current values of the backlight module.

18. The temperature adjustment method according to claim 10, further comprising: adjusting an upper limit current value of the backlight module to the maximum current value after the second time period.

* * * * *